US011062571B2

(12) United States Patent
Sugita

(10) Patent No.: US 11,062,571 B2
(45) **Date of Patent: *Jul. 13, 2021**

(54) SETTLEMENT APPARATUS AND METHOD OF SETTLING A TRANSACTION USING THE SAME

(71) Applicant: TOSHIBA TEC KABUSHIKI KAISHA, Tokyo (JP)

(72) Inventor: Nobuhiro Sugita, Mishima Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 137 days.

This patent is subject to a terminal disclaimer.

(21) Appl. No.: 16/397,632

(22) Filed: Apr. 29, 2019

(65) Prior Publication Data

US 2019/0251800 A1 Aug. 15, 2019

Related U.S. Application Data

(63) Continuation of application No. 15/686,898, filed on Aug. 25, 2017, now Pat. No. 10,319,197.

(30) Foreign Application Priority Data

Sep. 20, 2016 (JP) ..... 2016-182992

(51) Int. Cl.

| | |
|---|---|
| ***G07G 1/00*** | (2006.01) |
| ***G07G 1/06*** | (2006.01) |
| ***G07G 1/14*** | (2006.01) |

(52) U.S. Cl.

CPC ..... *G07G 1/0036* (2013.01); *G07G 1/0018* (2013.01); *G07G 1/06* (2013.01); *G07G 1/14* (2013.01)

(58) Field of Classification Search

CPC .. G07G 1/0009; G07G 1/0018; G07G 1/0036; G07G 1/0045; G07G 1/06;

(Continued)

(56) References Cited

U.S. PATENT DOCUMENTS

| | | | | |
|---|---|---|---|---|
| 7,866,546 | B1 | 1/2011 | Vance | |
| 10,319,197 | B2 * | 6/2019 | Sugita | G07G 1/0036 |

(Continued)

FOREIGN PATENT DOCUMENTS

| | | | |
|---|---|---|---|
| CN | 101436329 | A | 5/2009 |
| CN | 104794830 | A | 7/2015 |
| CN | 107038821 | A | 8/2017 |

*Primary Examiner* — Suezu Ellis

(74) *Attorney, Agent, or Firm* — Kim & Stewart LLP

(57) ABSTRACT

A settlement apparatus according to an embodiment includes first and second display devices, and first and second input devices. A money receiving unit receives and discharges money and is rotatable between a first position facing the operator and a second position facing the customer. When the money receiving unit is in the second position, a processor performs a settlement transaction in which the customer inserts money into the money receiving unit. The processor receives an input indicating one of the operator and the customer should confirm completion of the settlement transaction. When the received input indicates that the customer should confirm completion of the settlement transaction, the second display device displays at least one settlement execution button. The processor completes the settlement transaction based on an input received in the second input device with respect to the at least one settlement execution button.

8 Claims, 10 Drawing Sheets

(58) Field of Classification Search
CPC ... G07G 1/14; A47F 9/047; A47F 9/04; A47F 9/043; A47F 9/045; G06Q 20/20
USPC ..... 235/383; 705/16
See application file for complete search history.

(56) References Cited

U.S. PATENT DOCUMENTS

2003/0006098 A1 1/2003 Wike, Jr. et al.
2003/0061066 A1* 3/2003 Ochiai ..... H04W 4/24 455/41.2
2003/0078857 A1 4/2003 Ookushi
2005/0263590 A1 12/2005 Branck et al.
2007/0069013 A1 3/2007 Seifert et al.
2007/0138269 A1 6/2007 Baitz et al.
2007/0235531 A1 10/2007 Addison et al.
2007/0268664 A1 11/2007 Kobayashi
2009/0198582 A1* 8/2009 Tokorotani ..... G06Q 20/208 705/17
2010/0128048 A1* 5/2010 Makino ..... G09G 3/3611 345/581
2010/0202113 A1 6/2010 Fushimi
2011/0055028 A1* 3/2011 Sano ..... G06Q 20/20 705/16
2011/0109926 A1 5/2011 Asaga
2011/0225055 A1* 9/2011 Takahashi ..... G07G 1/0045 705/16
2011/0225056 A1* 9/2011 Akiyama ..... G07G 1/01 705/16
2014/0360816 A1 12/2014 Kesterson et al.
2015/0095134 A1* 4/2015 Parker ..... G06Q 20/322 705/14.38
2015/0149311 A1 5/2015 Ward et al.
2016/0203456 A1 7/2016 Herring et al.
2017/0228716 A1 8/2017 Sugita

* cited by examiner

SETTLEMENT APPARATUS AND METHOD OF SETTLING A TRANSACTION USING THE SAME

CROSS-REFERENCE TO RELATED APPLICATIONS

This application is a continuation of U.S. patent application Ser. No. 15/686,898, filed on Aug. 25, 2017, which is based upon and claims the benefit of priority from Japanese Patent Application No. 2016-182992, filed on Sep. 20, 2016, the entire contents of each of which are incorporated herein by reference.

FIELD

Embodiments described herein relate generally to a settlement apparatus, and a related method and control program.

BACKGROUND

In a semi-self-service type checkout system, a salesperson performs an operation for registration of contents of a commercial transaction such as registration of purchased merchandise, and a customer performs an operation for settlement of the commercial transaction.

According to this kind of checkout system, labor of a salesperson can be reduced, and a waiting time of a customer during busy times can be shortened.

However, at off-peak times, despite the fact that a salesperson is free, much labor may be imposed on a customer. Also, at off-peak times, the waiting time of the customer may be short, but the customer does not enjoy the benefit of the short waiting time as described above.

For these reasons, there is a desire that a salesperson can flexibly change the labor of a customer relating to settlement.

DETAILED DESCRIPTION

An exemplary embodiment provides a settlement apparatus, and a related method and control program with which a salesperson can flexibly change labor of a customer related to settlement.

A settlement apparatus according to an embodiment includes a first display device facing an operator, a first input device facing the operator, a second display device facing a customer, and a second input device facing the customer. A money receiving unit receives and discharges money and is rotatable between a first position facing the operator and a second position facing the customer. A processor receives registration information relating to merchandise for purchase in a transaction, and generates a total price of the transaction based on the registration information. When the money receiving unit is determined to be in the second position, the processor perform a settlement transaction based on the generated total price in which the customer inserts money for the transaction into the money receiving unit. The generated total price and a current total amount of money inserted into the money receiving unit are displayed on the first display device and the second display device. The processor receives an input from the first input device indicating one of the operator and the customer should confirm completion of the settlement transaction. When the received input from the first input device indicates that the customer should confirm completion of the settlement transaction, the processor controls the second display device to display at least one settlement execution button. The processor completes the settlement transaction based on an input received in the second input device with respect to the at least one settlement execution button.

Hereinafter, an example of an embodiment will be described with reference to the drawings. In the present embodiment, a semi-self-service checkout apparatus (hereinafter, referred to simply as a checkout apparatus) having a function as a settlement apparatus will be described.

Figure 1:
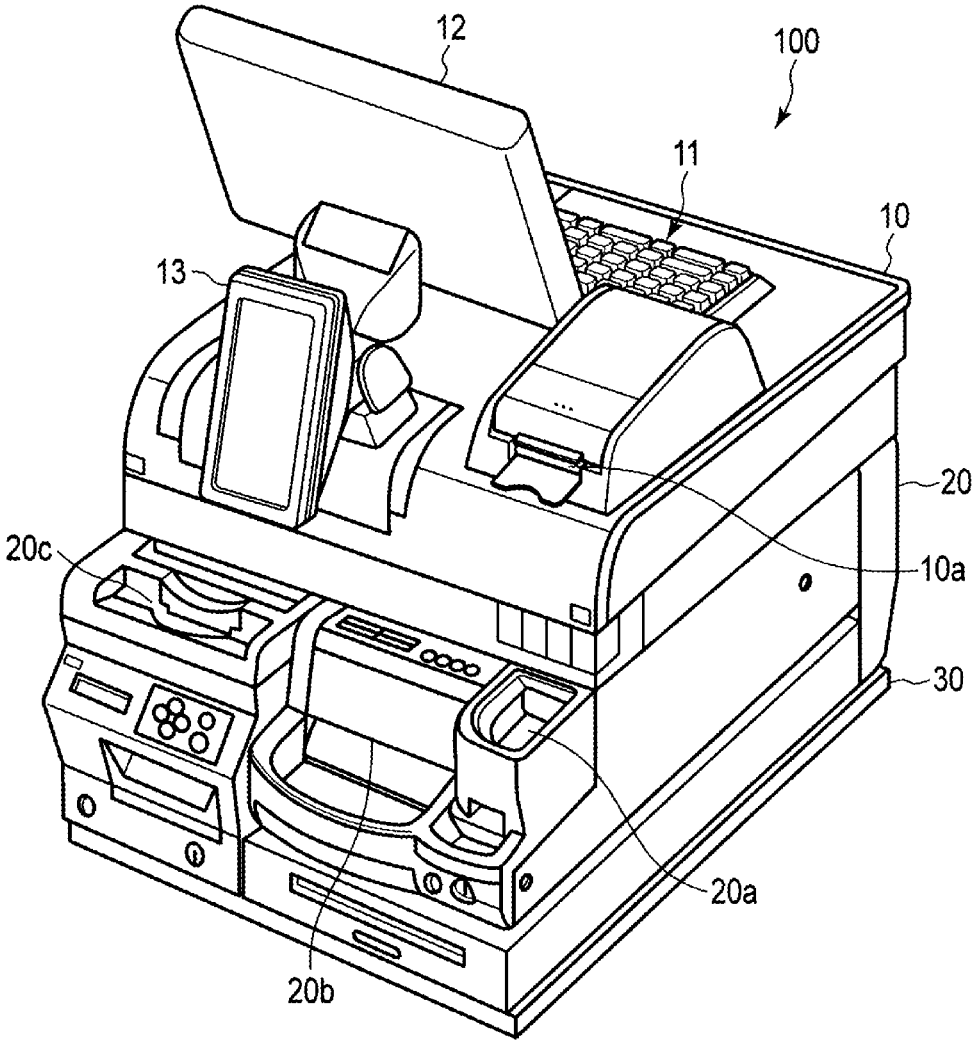
FIG. 1 is a perspective view of a checkout apparatus according to an embodiment.

FIG. 1 is a perspective view of a checkout apparatus 100 according to the present embodiment.

The checkout apparatus 100 includes a main unit 10, a money receiving unit 20, and a base 30.

The main unit 10 is fixed to the plate-shaped base 30 by, for example, a rod-shaped connection member (not illustrated) disposed through the money receiving unit 20. The money receiving unit 20 is moveable relative to any of the main unit 10, the base 30, and the connection member. For example, the money receiving unit 20 can rotate along the upper surface of the base 30, with the connection member as an axis. A rotatable angle of the money receiving unit 20 is at least 180 degrees. That is, the money receiving unit 20 may be in a state of facing the direction illustrated in FIG. 1 and in a state of facing opposite to the direction illustrated in FIG. 1. The checkout apparatus 100 is installed in a store or the like where a commercial transaction is performed, and is used in a state where a salesperson is located at the right rear side of FIG. 1 and a customer is located at the left front side of FIG. 1. Thus, in the following description, the right rear side of FIG. 1 is referred to as a salesperson side, and the left front side is referred to as a customer face side. In addition, the state of the money receiving unit 20 illustrated in FIG. 1 is referred to as a state of facing the customer.

The main unit 10 includes a keyboard 11, a main touch panel 12, and a sub touch panel 13. In addition, a receipt discharge port 10*a* is formed in a housing of the main unit 10.

A coin insertion port 20*a*, a coin discharge port 20*b*, and a bill insertion and discharge port 20*c* are formed in a housing of the money receiving unit 20.

Details of the components provided in the main unit 10 and the money receiving unit 20 will be described later.

Figure 2:
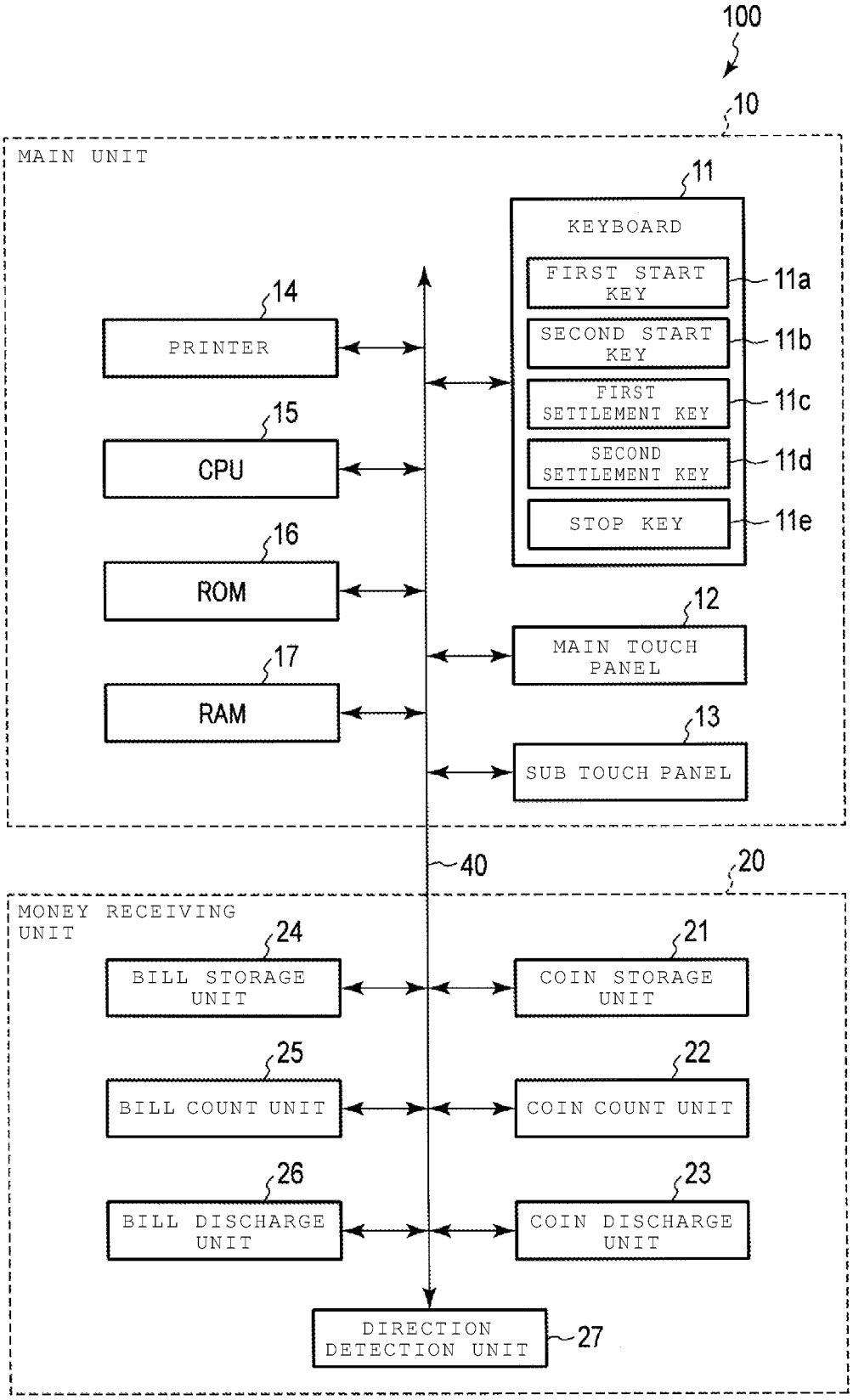
FIG. 2 is a block diagram illustrating an example configuration of the checkout apparatus.

FIG. 2 is a block diagram illustrating an example configuration of the checkout apparatus 100. In FIG. 2, the same reference numerals are given to the same components as those illustrated in FIG. 1.

The main unit 10 includes a printer 14, a central processing unit (CPU) 15, a read only memory (ROM) 16, and a random-access memory (RAM) 17, in addition to the keyboard 11, the main touch panel 12, and the sub touch panel 13. The keyboard 11, the main touch panel 12, the sub touch panel 13, the printer 14, the CPU 15, the ROM 16, and the RAM 17 are connected to a transmission line 40. The transmission line 40 may be an address bus, a data bus, a control signal line, and the like. The transmission line 40 connects the main unit 10 to the money receiving unit 20. The transmission line 40 is divided into the main unit 10 side and the money receiving unit 20 side, and may further include an interface circuit that connects the portions to each other.

The keyboard 11 includes a number of keys, and receives input instructions from a salesperson based on press of the keys. The keys of the keyboard 11 include a first start key 11*a*, a second start key lib, a first settlement key 11*c*, a second settlement key 11*d*, and a stop key 11*e*. The first start key 11*a* is a key that allows a salesperson to instruct whether to start settlement according to an operation of the salesperson. The second start key lib is a key that allows a salesperson to instruct whether to start settlement according to an operation of a customer. The first settlement key 11*c* is a key that allows a salesperson to instruct whether to perform settlement with issuing of a purchase certificate. The second settlement key 11*d* is a key that allows a salesperson to instruct whether to perform settlement without issuing of a purchase certificate. The stop key 11*e* is a key that allows a salesperson to instruct whether to stop cash insertion during the cash insertion for settlement. The keyboard 11 is an example of a second input device.

The main touch panel 12 is provided facing the salesperson side as illustrated in FIG. 1. The main touch panel 12 displays a screen for providing information to a salesperson. In addition, the main touch panel 12 receives input instructions from a salesperson according to a touch input on the displayed screen.

The sub touch panel 13 is provided toward the customer face side as illustrated in FIG. 1. The sub touch panel 13 displays a screen for providing information to a customer. In addition, the sub touch panel 13 receives input instructions from a customer according to a touch input on the displayed screen. That is, the sub touch panel 13 is an example of a first input device.

The printer 14 prints a receipt image or a purchase certificate image on receipt paper. The printer 14 discharges the receipt paper on which the receipt image or the purchase certificate image is printed, from the receipt discharge port 10*a* illustrated in FIG. 1 to the outside of the main unit 10.

The CPU 15, the ROM 16, and the RAM 17 are connected to each other via the transmission line 40, and constitute a computer that controls the checkout apparatus 100.

The CPU 15 corresponds to a central processor of the computer. Based on an operating system and application programs stored in the ROM 16, the CPU 15 controls each component of the checkout apparatus 100 in order to realize various functions of the checkout apparatus 100.

The ROM 16 corresponds to a main memory of the computer. The ROM 16 stores an operating system and application programs. One of the application programs is a control program for control processing to be described later. In addition, the ROM 16 may store data to be referred to when the CPU 15 performs various processing.

The RAM 17 corresponds to a working memory of the computer. The RAM 17 stores data to be referred to when the CPU 15 performs various processing. Further, the RAM 17 is used as a so-called work area that temporarily stores data to be used when the CPU 15 performs various processing.

The money receiving unit 20 includes a coin storage unit 21, a coin count unit 22, a coin discharge unit 23, a bill storage unit 24, a bill count unit 25, a bill discharge unit 26, and a direction detection unit 27. Each of the coin storage unit 21, the coin count unit 22, the coin discharge unit 23, the bill storage unit 24, the bill count unit 25, the bill discharge unit 26, and the direction detection unit 27 are connected to the transmission line 40. Each of the coin storage unit 21, the coin count unit 22, the coin discharge unit 23, the bill storage unit 24, the bill count unit 25, the bill discharge unit 26, and the direction detection unit 27 are implemented as appropriate hardware configured to perform the various functions, as controlled by the CPU 15 and/or an application specific integrated circuit (ASIC) or a field programmable gate array (FPGA), for example.

The coin storage unit 21 stores coins inserted from the coin insertion port 20*a* illustrated in FIG. 1 into a coin storage box (not illustrated).

The coin count unit 22 counts an amount of coins inserted from the coin insertion port 20*a*.

The coin discharge unit 23 discharges coins from the coin discharge port 20*b* illustrated in FIG. 1 to the outside of the money receiving unit 20.

The bill storage unit 24 stores bills (i.e., paper currency) inserted from the bill insertion and discharge port 20*c* illustrated in FIG. 1 into a bill storage box (not illustrated).

The bill count unit 25 counts an amount of bills inserted from the bill insertion and discharge port 20*c*.

The bill discharge unit 26 discharges bills from the bill insertion and discharge port 20*c* illustrated in FIG. 1 to the outside of the money receiving unit 20.

The direction detection unit 27 detects whether or not the money receiving unit 20 is in a state of facing the customer. Whether or not the money receiving unit 20 is in a state of facing the customer may be detected by a direction detection unit provided in the main unit 10, and in this case, the direction detection unit 27 may be omitted.

Next, an operation of the checkout apparatus 100 configured as described above will be described.

When the checkout apparatus 100 is in an operating state, the CPU 15 waits until any of various instructions is performed. The CPU 15 starts the control processing according to the control program stored in the ROM 16. An operation for instructing execution of accounting related to a commercial transaction is performed by, for example, the keyboard 11. Contents of the processing to be described below are merely examples, and various processing capable of obtaining the same results may be appropriately used.

FIGS. 3, 4, 5, and 6 are flowcharts of the control processing by the CPU 15.

Figure 3:
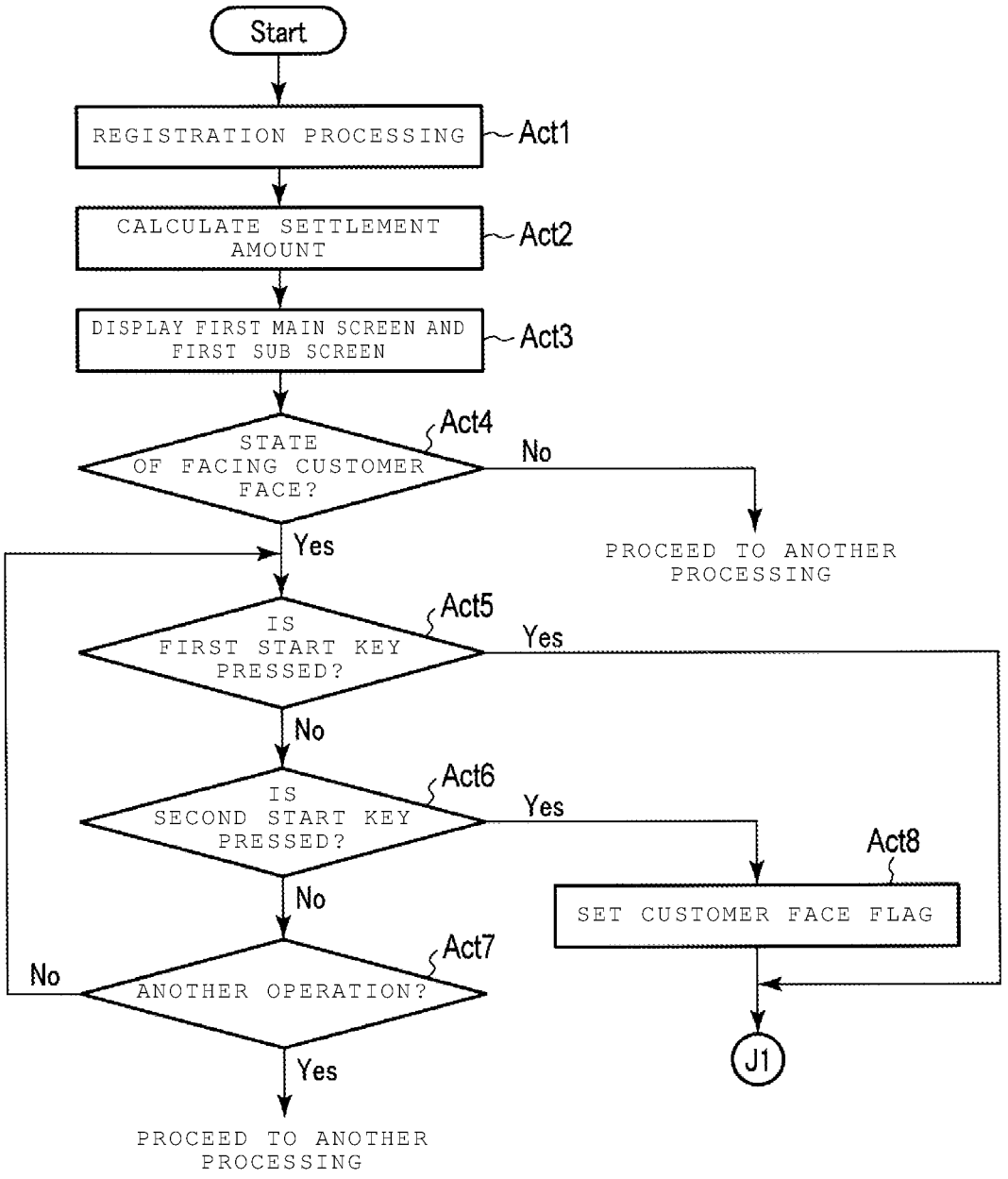
FIGS. 3-6 are flowcharts of example operations for control processing by the checkout apparatus.

In Act 1 of FIG. 3, the CPU 15 performs registration processing for registering contents of a commercial transaction. Specifically, the CPU 15 waits until a registration operation is performed by an operator. For example, it is assumed that the checkout apparatus 100 is used in a bread store which makes and sells bread. At a bread store, in many cases, merchandise is not wrapped, and no bar code is attached to each item of merchandise. Thus, each item of the merchandise is assigned to a key included in the keyboard 11 or a button displayed on the main touch panel 12. A salesperson presses a key assigned to the purchased merchandise or touches a button, as the registration operation. The CPU 15 updates information in a merchandise list area which is set in the RAM 17 so as to add the merchandise assigned to the pressed key or the touched button into a list of the purchased merchandise. Here, the registration operation may be performed by another known operation such as an operation of causing a scanner to read a bar code displayed on the merchandise. In this case, a device such as a scanner is provided in the main unit 10 as necessary. Further, the commercial transaction to be registered is not limited to purchase and sale of merchandise, and may be provision of a service or the like. In this way, the CPU 15 executes the control processing based on the control program, and thus the computer including the CPU 15 functions as a registration unit.

When a salesperson confirms that registration of all purchased merchandise is completed and presses, for example, a subtotal key provided on the keyboard 11, the CPU 15 ends the registration processing and proceeds to Act 2.

In Act 2, the CPU 15 calculates a settlement amount to be settled for purchase of all registered merchandise. As a result, the CPU 15 determines the settlement amount. The CPU 15 executes the control processing based on the control program, and thus the computer including the CPU 15 functions as an acquisition unit.

In Act 3, the CPU 15 displays a first main screen on the main touch panel 12, and displays a first sub screen on the sub touch panel 13, respectively.

Figure 7:
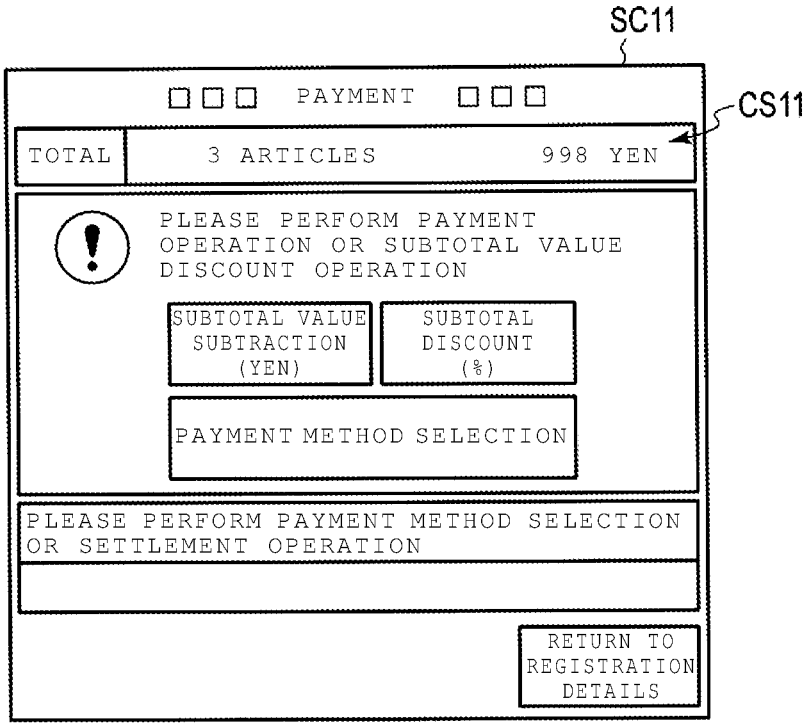
FIG. 7 illustrates an example first main screen.

FIG. 7 illustrates an example first main screen SC11.

The first main screen SC11 includes a character string CS11 representing the settlement amount calculated in Act 2. In other words, the first main screen SC11 is a screen for notifying a salesperson of the settlement amount.

Figure 8:
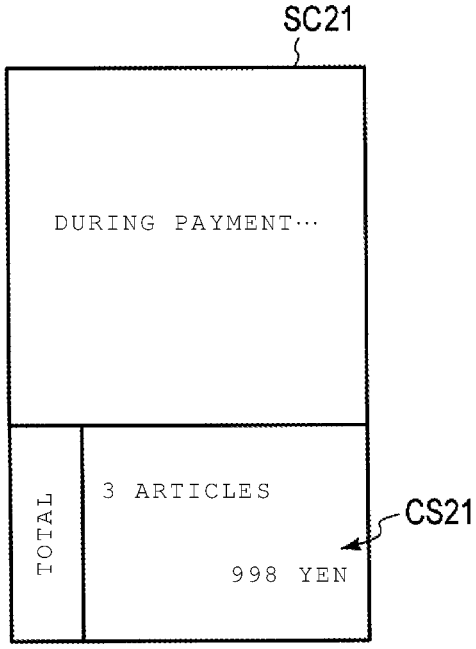
FIG. 8 illustrates an example first sub screen.

FIG. 8 illustrates an example first sub screen SC21.

The first sub screen SC21 includes a character string CS21 representing the settlement amount calculated in Act 2. In other words, the first sub screen SC21 is a screen for notifying a customer of the settlement amount.

In Act 4, the CPU 15 determines whether or not the money receiving unit 20 is in a state of facing the customer by referring to the detection result of the direction detection unit 27. When the money receiving unit 20 is not in a state of facing the customer, the CPU 15 determines that the determination result is No, and proceeds to another processing. Here, an example of another processing is processing for handling a case where the salesperson receives cash for settlement from the customer, and the salesperson inserts the cash into the money receiving unit 20. Another processing which is performed according to existing checkout apparatuses may be applied as it is, and thus illustration and explanation thereof will be omitted.

Instead of providing the direction detection unit 27, the CPU 15 may set a flag, which manages whether or not the money receiving unit 20 is in a state of facing the customer, to ON or OFF according to an instruction operation by the operator, and then may perform determination of Act 4 based on the flag.

On the other hand, when the direction detection unit 27 detects (via the direction detection unit 27 or the flag) that the money receiving unit 20 is in a state of facing the customer, the CPU 15 determines that the determination result in Act 4 is Yes, and proceeds to Act 5.

In Act 5, the CPU 15 determines whether or not the first start key 11*a* is pressed. When the first start key 11*a* is not pressed, the CPU 15 determines that the result is No, and proceeds to Act 6.

In Act 6, the CPU 15 determines whether or not the second start key 11*b* is pressed. When the second start key 11*b* is not pressed, the CPU 15 determines that the result is No, and proceeds to Act 7.

In Act 7, the CPU 15 determines whether or not another operation other than pressing of the first start key 11*a* or pressing of the second start key 11*b* is performed. When another operation other than pressing of the first start key 11*a* or pressing of the second start key 11*b* is not performed, the CPU 15 determines that the result is No, and returns to Act 5.

In this way, in Act 5 to Act 7, the CPU 15 waits until the first start key 11*a* is pressed, the second start key 11*b* is pressed, or another operation is performed. When another operation is performed, the CPU 15 determines that the result in Act 7 is Yes, and proceeds to a process corresponding to the performed operation. In this case, the process to be performed may be arbitrary and is not a feature of the present embodiment, and thus illustration and explanation thereof will be omitted.

When the salesperson determines that the salesperson will perform the settlement operation, the salesperson presses the first start key 11*a*. In addition, when the salesperson determines to apply self-service settlement, i.e., that the customer will perform the settlement operation, the salesperson presses the second start key 11*b*.

When the second start key 11*b* is pressed, the CPU 15 determines that the result in Act 6 is Yes, and proceeds to Act 8. In this way, the CPU 15 executes the control processing based on the control program, and thus the computer including the CPU 15 functions as a second input processing unit that inputs the self-service settlement start instruction by the salesperson. A function as a second input unit is realized by cooperation of the second input processing unit and the keyboard 11.

In Act 8, the CPU 15 sets a customer face flag. For example, the customer face flag may have a value of 0 or 1, and in Act 8, the CPU 15 sets the customer face flag to 1. Thereafter, the CPU 15 proceeds to Act 11 of FIG. 4. The CPU 15 resets the customer face flag at the start of the control processing illustrated in FIGS. 3 to 6. For example, at the start of the control processing illustrated in FIGS. 3 to 6, the CPU 15 resets the customer face flag to 0.

When the first start key 11*a* is pressed in a standby state of Act 5 to Act 7, the CPU 15 determines that the result in Act 5 is Yes. Thus, the CPU 15 skips Act 8, and proceeds to Act 11 of FIG. 4. That is, when the first start key 11*a* is pressed, the CPU 15 keeps the customer face flag in the reset state. For example, when the first start key 11*a* is pressed, the CPU 15 keeps the customer face flag reset at 0.

Figure 4:
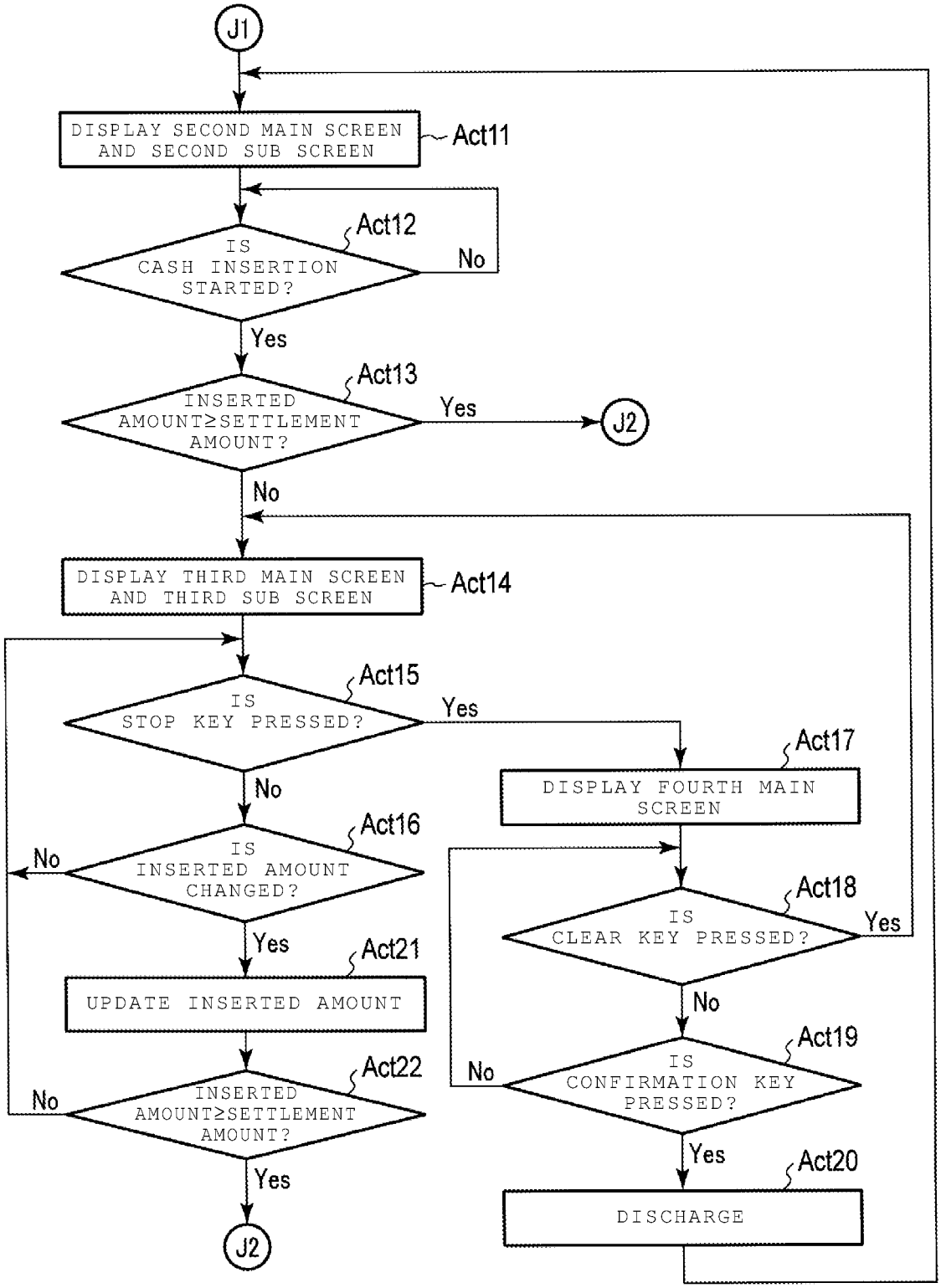

In Act 11 of FIG. 4, the CPU 15 displays a second main screen on the main touch panel 12, and displays a second sub screen on the sub touch panel 13, respectively.

Figure 9:
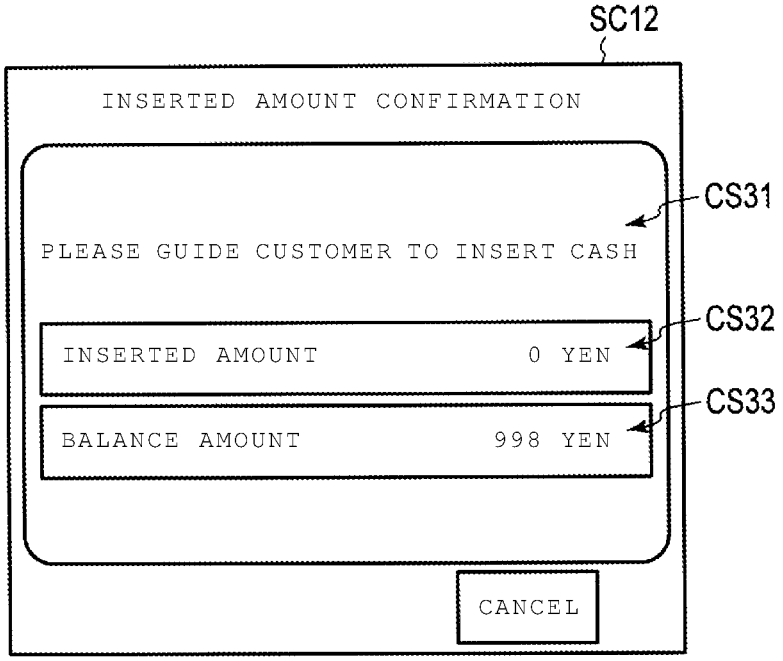
FIG. 9 illustrates an example second main screen.

FIG. 9 illustrates an example second main screen SC12.

The second main screen SC12 includes character strings CS31, CS32, and CS33. The character string CS31 represents a predetermined character message for prompting the salesperson to guide the customer to insert cash as a payment into the coin insertion port 20*a* or the bill insertion and discharge port 20*c*. In FIG. 9, the character string CS32 represents that an amount of inserted cash (hereinafter, referred to as an inserted amount) is 0 yen. The character string CS33 represents a balance amount that the customer has to insert in order to settle the settlement amount. That is, the character string CS33 represents the settlement amount calculated by the CPU 15 in Act 2.

Figure 10:
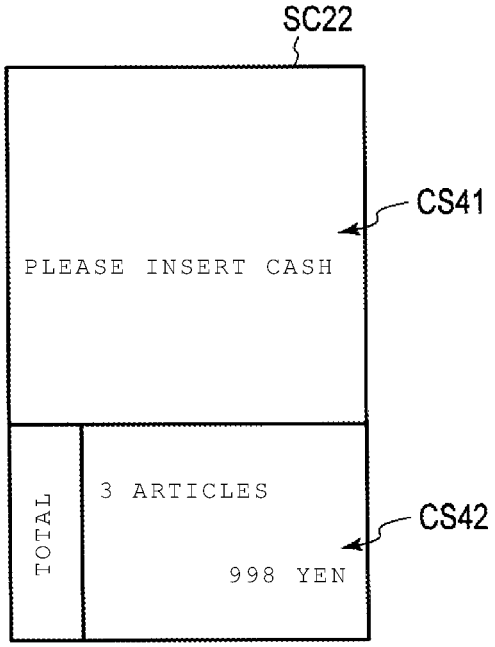
FIG. 10 illustrates an example second sub screen.

FIG. 10 is a diagram illustrating a second sub screen SC22 as an example.

The second sub screen SC22 includes character strings CS41 and CS42. The character string CS41 represents a predetermined character message for guiding the customer to insert cash as a payment into the coin insertion port 20*a* or the bill insertion and discharge port 20*c*. The character string CS42 represents a cash amount to be inserted as a payment, that is, the settlement amount calculated in Act 2.

In Act 12, the CPU 15 determines whether or not insertion of cash into the coin insertion port 20*a* or the bill insertion and discharge port 20*c* is started. When all of the amount of money counted by the coin count unit 22 and the amount of money counted by the bill count unit 25 are zero, the CPU 15 determines that the result in Act 12 is No, and repeats Act 12. In this way, in Act 12, the CPU 15 waits until insertion of cash is started. The CPU 15 clears count amounts of the coin count unit 22 and the bill count unit 25 to zero at the start of the control processing illustrated in FIGS. 3 to 6.

The customer inserts coins of cash as a payment into the coin insertion port 20*a*, and inserts bills of cash as a payment into the bill insertion and discharge port 20*c*, respectively. When coins are inserted into the coin insertion port 20*a*, the coin storage unit 21 transports and stores the coins. The coin count unit 22 counts an amount of the coins transported and stored by the coin storage unit 21. Each time the counted amount changes, the coin count unit 22 notifies the CPU 15 of the counted amount. When bills are inserted into the bill insertion and discharge port 20*c*, the bill storage unit 24 transports and stores the bills. The bill count unit 25 counts an amount of the bills transported by the bill storage unit 24. Each time the counted amount changes, the bill count unit 25 notifies the CPU 15 of the counted amount. In this way, each of the coin count unit 22 and the bill count unit 25 is an example of a count unit that counts the amount of cash inserted by the customer. When the non-zero amount is notified from the coin count unit 22 or the bill count unit 25 in this manner, in response to the notification, the CPU 15 determines that the result in Act 12 is Yes, and proceeds to Act 13.

In Act 13, the CPU 15 determines whether or not the inserted amount is equal to or greater than the settlement amount. When the inserted amount is less than the settlement amount, the CPU 15 determines that the result in Act 13 is No, and proceeds to Act 14.

In Act 14, the CPU 15 displays a third main screen on the main touch panel 12, and displays a third sub screen on the sub touch panel 13, respectively.

Figure 11:
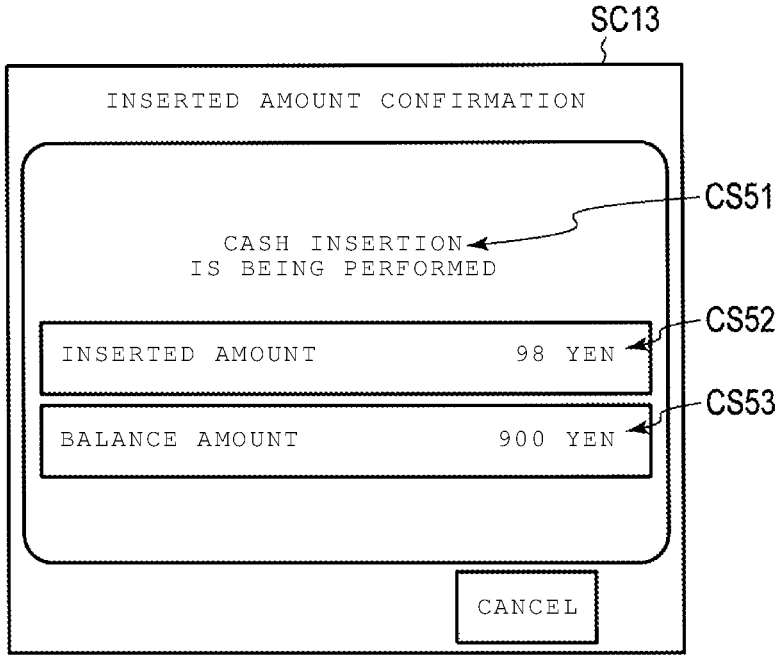
FIG. 11 illustrates an example third main screen.

FIG. 11 illustrates an example third main screen SC13.

The third main screen SC13 includes character strings CS51, CS52, and CS53. The character string CS51 represents a predetermined character message for notifying the salesperson that cash is being inserted as a payment. The character string CS52 represents an inserted amount at the present time. The character string CS53 represents a balance amount at the present time. That is, the character string CS52 represents the total amount of money most recently notified to the CPU 15 from each of the coin count unit 22 and the bill count unit 25. The CPU 15 calculates, as the character string CS53, an amount of money which is obtained by subtracting the total amount of money from the settlement amount calculated in Act 2.

Figure 12:
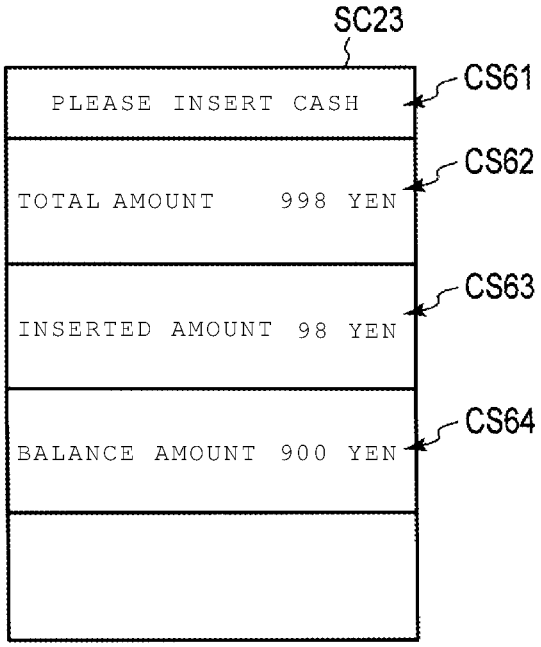
FIG. 12 illustrates an example third sub screen.

FIG. 12 illustrates an example third sub screen SC23.

The third sub screen SC23 includes character strings CS61, CS62, CS63, and CS64. The character string CS61 represents a predetermined character message for guiding the customer to insert cash as a payment into the coin insertion port 20*a* or the bill insertion and discharge port 20*c*. The character string CS62 represents a cash amount to be inserted as a payment, that is, the settlement amount calculated in Act 2. The character string CS63 represents the inserted amount at the present time. The character string CS64 represents the balance amount at the present time. The CPU 15 sets the character strings CS63 and CS64 to be the same as the character strings CS52 and CS53 which are simultaneously displayed on the third main screen SC13.

In Act 15, the CPU 15 determines whether or not the stop key 11*e* is pressed. When the stop key 11*e* is not pressed, the CPU 15 determines that the result in Act 15 is No, and proceeds to Act 16.

In Act 16, the CPU 15 determines whether or not the inserted amount is changed. When an amount of money is not newly notified from any of the coin count unit 22 and the bill count unit 25, the CPU 15 determines that the result in Act 16 is No, and returns to Act 15.

In this way, in Act 15 and Act 16, the CPU 15 waits until the stop key 11*e* is pressed or additional cash is inserted.

In a case where the cash insertion is stopped according to a request or the like of the customer, the salesperson presses the stop key 11*e*. Then, the CPU 15 determines that the result in Act 15 is Yes, and proceeds to Act 17.

In Act 17, the CPU 15 causes the main touch panel 12 to display the fourth main screen.

Figure 13:
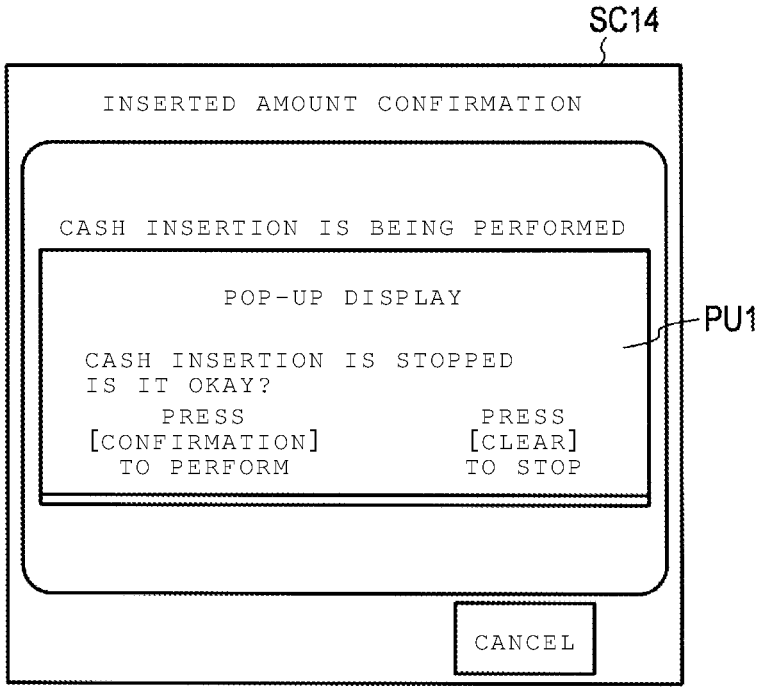
FIG. 13 illustrates an example fourth main screen.

FIG. 13 illustrates an example fourth main screen SC14.

The fourth main screen SC14 is a screen in which a pop-up display PU1 is added to the third main screen SC13. The pop-up display PU1 represents a character message prompting the salesperson to instruct whether to perform a cash insertion stop operation.

In Act 18, the CPU 15 determines whether or not a clear key included in the keyboard 11 is pressed. When the clear key is not pressed, the CPU 15 determines that the result in Act 18 is No, and proceeds to Act 19.

In Act 19, the CPU 15 determines whether or not a confirmation key included in the keyboard 11 is pressed. When the confirmation key is not pressed, the CPU 15 determines that the result in Act 19 is No, and returns to Act 18.

In this way, in Act 18 and Act 19, the CPU 15 waits until the clear key or the confirmation key is pressed.

When canceling the cash insertion stop operation, the salesperson presses the clear key. Then, the CPU 15 determines that the result in Act 18 is Yes, and returns to Act 14. That is, the CPU 15 returns the screen of the main touch panel 12 to the third main screen, and then returns to a standby state of Act 15 and Act 16.

On the other hand, when performing the cash insertion stop operation, the salesperson presses the confirmation key. Then, the CPU 15 determines that the result in Act 19 is Yes, and proceeds to Act 20.

In Act 20, the CPU 15 instructs the coin discharge unit 23 and the bill discharge unit 26 to discharge cash corresponding to the inserted amount at this point. According to the instruction, the coin discharge unit 23 and the bill discharge unit 26 discharge coins and bills. Then, the CPU 15 returns to Act 11. That is, the CPU 15 returns the screen of the main touch panel 12 and the screen of the sub touch panel 13 to the second main screen and the second sub screen, and then returns to a standby state of Act 12. At this time, the CPU 15 clears the amounts of money counted by each of the coin count unit 22 and the bill count unit 25 and the inserted amount, to zero.

In this way, each of the coin discharge unit 23 and the bill discharge unit 26 is an example of a discharge unit that discharges inserted cash. The CPU 15 executes the control processing based on the control program. Thus, when the salesperson presses the stop key 11*e*, the CPU 15 receives a stop instruction input by the salesperson. Therefore, the CPU 15 functions as a fourth input unit by cooperating with the stop key 11*e*. In addition, the CPU 15 functions as a stop unit.

In the standby state of Act 15 and Act 16, when the customer additionally inserts cash, an amount of money is newly notified from the coin count unit 22 or the bill count unit 25. Thus, the CPU 15 determines that the result in Act 16 is Yes, and proceeds to Act 21.

In Act 21, the CPU 15 updates the inserted amount by adding the newly notified amount.

In Act 22, the CPU 15 determines whether or not the inserted amount is equal to or greater than the settlement amount. When the inserted amount is less than the settlement amount, the CPU 15 determines that the result in Act 22 is No, and returns to the standby state of Act 15 and Act 16. On the other hand, when the inserted amount is equal to or greater than the settlement amount, the CPU 15 determines that the result in Act 22 is Yes, and proceeds to Act 31 of FIG. 5. When the cash amount initially inserted is equal to or greater than the settlement amount, the CPU 15 determines that the result in Act 13 is Yes. Thus, the CPU 15 skips Act 14 to Act 22, and proceeds to Act 31 of FIG. 5.

Figure 5:
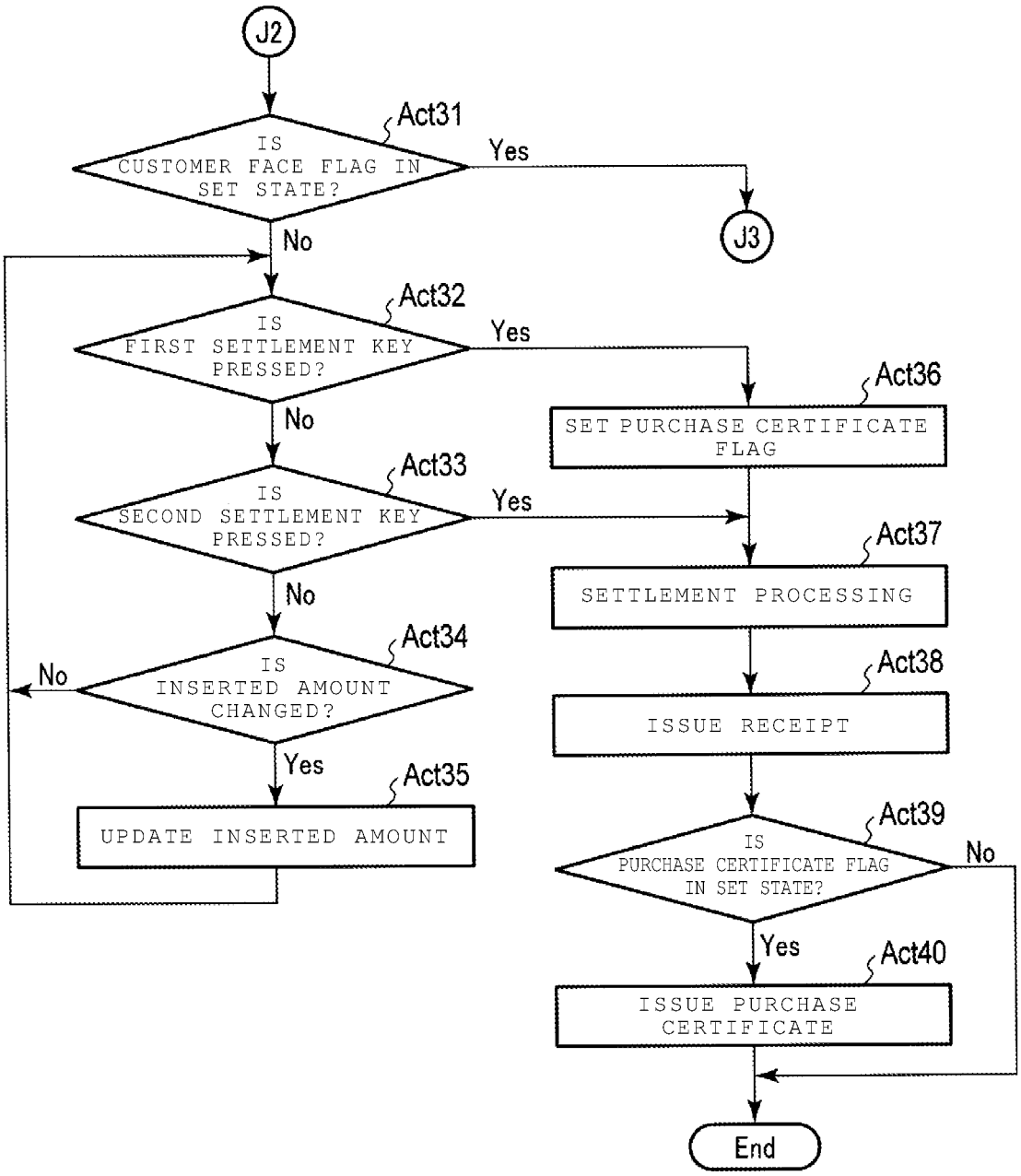

In Act 31 of FIG. 5, the CPU 15 determines whether or not the customer face flag is in a set state (i.e., set to 1). When the customer face flag is in a reset state (i.e., set to 0), the CPU 15 determines that the result in Act 31 is No, and proceeds to Act 32.

In Act 32, the CPU 15 determines whether or not the first settlement key 11*c* is pressed. When the first settlement key 11*c* is not pressed, the CPU 15 determines that the result in Act 32 is No, and proceeds to Act 33.

In Act 33, the CPU 15 determines whether or not the second settlement key 11*d* is pressed. When the second settlement key 11*d* is not pressed, the CPU 15 determines that the result in Act 33 is No, and proceeds to Act 34.

In Act 34, the CPU 15 determines whether or not the inserted amount is changed. When a new amount of money is not notified from any of the coin count unit 22 and the bill count unit 25, the CPU 15 determines that the result in Act 34 is No, and returns to Act 32.

In this way, in Act 32 to Act 34, the CPU 15 waits until the first settlement key 11*c* or the second settlement key 11*d* is pressed or cash is additionally inserted. When the customer additionally inserts cash, a new amount of money is notified from the coin count unit 22 or the bill count unit 25. Thus, the CPU 15 determines that the result in Act 34 is Yes, and proceeds to Act 35.

In Act 35, the CPU 15 updates the inserted amount by adding the new notified amount. At this time, the CPU 15 changes each of the character strings CS52 and CS53 on the third main screen SC13 and the character strings CS63 and SC64 on the third sub screen SC23. Thereafter, the CPU 15 returns to a standby state of Act 32 to Act 34.

In a case where the salesperson confirms that the customer completes the cash insertion, when the customer requests issue of a purchase certificate, the salesperson presses the first settlement key 11*c*. Then, the CPU 15 determines that the result in Act 32 is Yes, and proceeds to Act 36.

In Act 36, the CPU 15 sets a purchase certificate flag. For example, the purchase certificate flag may have a value of 0 or 1, and in Act 36, the CPU 15 sets the purchase certificate flag to 1. Thereafter, the CPU 15 proceeds to Act 37. The CPU 15 resets the purchase certificate flag at the start of the control processing illustrated in FIGS. 3 to 6. For example, at the start of the control processing illustrated in FIGS. 3 to 6, the CPU 15 resets the purchase certificate flag to 0.

In a case where the salesperson confirms that the customer completes the cash insertion, when the customer does not request issue of a purchase certificate, the salesperson presses the second settlement key 11*d*. Then, the CPU 15 determines that the result in Act 33 is Yes, skips Act 36, and proceeds to Act 37.

In Act 37, the CPU 15 performs settlement processing. The settlement processing may be a known processing of settling the settlement amount based on the inserted cash. In this way, the CPU 15 executes the control processing based on the control program, and thus the computer including the CPU 15 functions as a settlement unit.

As described above, when the salesperson presses the first settlement key 11*c* or the second settlement key 11*d*, the CPU 15 executes the settlement processing. That is, pressing of the first settlement key 11*c* or the second settlement key 11*d* by the salesperson is a settlement execution instruction by the salesperson. In this way, the CPU 15 executes the control processing based on the control program, and thus the computer including the CPU 15 functions as a third input unit that inputs the settlement execution instruction by the salesperson in cooperation with the keyboard 11. In addition, when the inserted amount is equal to or greater than the settlement amount, the computer including the CPU 15 executes the settlement processing according to the execution instruction by the salesperson. Therefore, the CPU 15 executes the control processing based on the control program, and thus the computer including the CPU 15 functions as a second control unit.

In Act 38, the CPU 15 issues a receipt. Specifically, the CPU 15 generates a receipt image representing contents of the commercial transaction and results of settlement, and instructs the printer 14 to print the receipt image.

In Act 39, the CPU 15 determines whether or not the purchase certificate flag is in the set state. When the purchase certificate flag is in the set state (i.e., set to 1), the CPU 15 determines that the result in Act 39 is Yes, and proceeds to Act 40.

In Act 40, the CPU 15 issues a purchase certificate. Specifically, the CPU 15 generates a purchase certificate image according to the contents of the commercial transaction, and instructs the printer 14 to print the purchase certificate image.

When the purchase certificate is issued, the CPU 15 ends the control processing. When the purchase certificate flag is in the reset state (i.e., set to 0), the CPU 15 determines that the result in Act 39 is No, skips Act 40, and ends the control processing.

Figure 6:
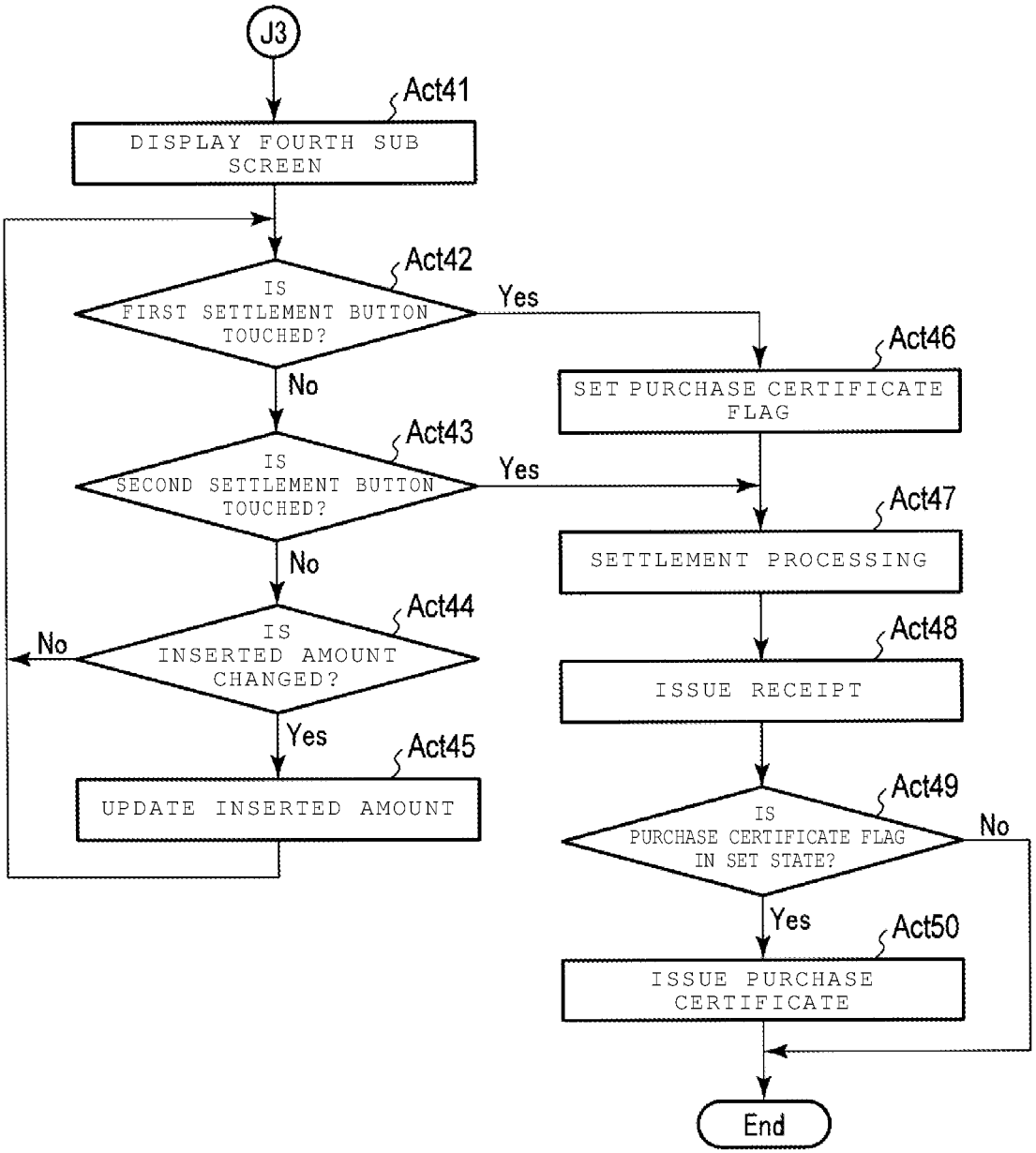

On the other hand, when the customer face flag is in the set state (i.e., set to 0), the CPU 15 determines that the result in Act 31 is Yes, and proceeds to Act 41 of FIG. 6.

In Act 41 of FIG. 6, the CPU 15 causes the sub touch panel 13 to display a fourth sub screen.

Figure 14:
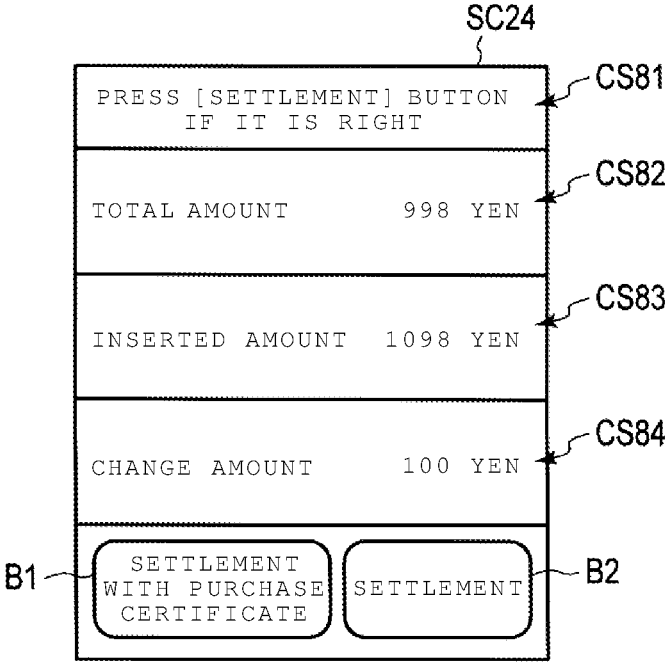
FIG. 14 illustrates an example fourth sub screen.

FIG. 14 illustrates an example fourth sub screen SC24.

The fourth sub screen SC24 includes character strings CS81, CS82, CS83 and CS84, a first settlement button B1, and a second settlement button B2. The character string CS81 represents a predetermined character message for guiding to the customer to press the settlement button when cash insertion is completed. The character string CS82 represents a cash amount to be inserted as a payment, that is, the settlement amount calculated in Act 2. The character string CS83 represents the inserted amount at the present time. The character string CS84 represents a change amount when the settlement is executed at the present time. That is, the character string CS84 represents an amount of money which the CPU 15 calculates by subtracting the settlement amount from the inserted amount. The first settlement button B1 is a button that allows a customer to perform settlement with issuing of a purchase certificate. The second settlement button B2 is a button that allows a customer to perform settlement without issuing of a purchase certificate. In this way, each of the first settlement button B1 and the second settlement button B2 is an example of an execution button for inputting a settlement execution instruction by the customer. The fourth sub screen SC24 displays the inserted amount counted, and includes the first settlement button B1 and the second settlement button B2 as execution buttons, and corresponds to a second screen. The third sub screen SC23 illustrated in FIG. 12 is a screen which displays the inserted amount counted and does not include the first settlement button B1 and the second settlement button B2 as execution buttons, and corresponds to a first screen.

In Act 42, the CPU 15 determines whether or not the first settlement button B1 is touched. When the first settlement button B1 is not touched, the CPU 15 determines that the result in Act 42 is No, and proceeds to Act 43.

In Act 43, the CPU 15 determines whether or not the second settlement button B2 is touched. When the second settlement button B2 is not touched, the CPU 15 determines that the result in Act 43 is No, and proceeds to Act 44.

In Act 44, the CPU 15 determines whether or not the inserted amount is changed. When an amount of money is not newly notified from any of the coin count unit 22 and the bill count unit 25, the CPU 15 determines that the result in Act 44 is No, and returns to Act 42.

In this way, in Act 42 to Act 44, the CPU 15 waits until the first settlement button B1 or the second settlement button B2 is touched or cash is additionally inserted. When the customer additionally inserts cash, an amount of money is newly notified from the coin count unit 22 or the bill count unit 25. Thus, the CPU 15 determines that the result in Act 44 is Yes, and proceeds to Act 45.

In Act 45, the CPU 15 updates the inserted amount by adding the newly notified amount. At this time, the CPU 15 changes each of the character strings CS52 and CS53 on the third main screen SC13 and the character strings CS83 and SC84 on the fourth sub screen SC24. Thereafter, the CPU 15 returns to a standby state of Act 42 to Act 44.

In a case where the customer completes cash insertion and desires issue of a purchase certificate, the customer touches the first settlement button B1. Then, the CPU 15 determines that the result in Act 42 is Yes, and proceeds to Act 46.

In Act 46, the CPU 15 sets the purchase certificate flag. Thereafter, the CPU 15 proceeds to Act 47.

In a case where the customer completes cash insertion and does not desire issuance of a purchase certificate, the customer touches the second settlement button B2. Then, the CPU 15 determines that the result in Act 43 is Yes, skips Act 46, and proceeds to Act 47.

In Act 47, the CPU 15 performs settlement processing. The settlement processing may be the same processing as Act 37. In this way, the CPU 15 executes the control processing based on the control program, and thus the computer including the CPU 15 functions as a settlement unit.

As described above, the CPU 15 executes the settlement processing according to the touch of the first settlement button B1 or the second settlement button B2 by the customer. That is, the touch of the first settlement button B1 or the second settlement button B2 by the customer is the settlement execution instruction by the customer. The computer functions as a first input processing unit that receives input of the settlement execution instruction by the customer in cooperation with the sub touch panel 13. A function as the first input unit is realized by cooperation of the first input processing unit and the sub touch panel 13. In addition, when the inserted amount is equal to or greater than the settlement amount, the computer causes the CPU 15 to execute the settlement processing according to the execution instruction by the customer, and execute the control processing based on the control program. Thus, the computer functions as a first control unit. Further, in a case where the customer face flag is in the reset state (i.e., set to 0), that is, in a case where a self-service settlement execution instruction is not input, the computer does not display the fourth sub screen SC24, and does not receive an input of the settlement execution instruction using the first settlement button B1 or the second settlement button B2. Here, the CPU 15 may cause the fourth sub screen SC24 to be displayed in a state where the first settlement button B1 and the second settlement button B2 are in an invalid state or in a non-display state. In this case, the CPU 15 does not receive an input of the settlement execution instruction using the first settlement button B1 or the second settlement button B2. In a case where the customer face flag is in the set state (i.e., set to 1), that is, in a case where the self-service settlement execution instruction is input, the computer displays the fourth sub screen SC24, and enables an input of the settlement execution instruction using the first settlement button B1 or the second settlement button B2. In this way, the computer functions as an enabling unit.

In addition, in a case where the customer face flag is in the reset state (i.e., set to 0), that is, in a case where the self-service settlement execution instruction is not input, the computer does not receive the settlement execution instruction according to pressing of the first settlement key 11*c* or the second settlement key 11*d*. Thus, the computer functions as a disabling unit.

In Act 48, the CPU 15 issues a receipt. The processing may be the same processing as Act 38.

In Act 49, the CPU 15 determines whether or not the purchase certificate flag is in the set state (i.e., set to 1). When the purchase certificate flag is in the set state (i.e., set to 1), the CPU 15 determines that the result in Act 49 is Yes, and proceeds to Act 50.

In Act 50, the CPU 15 issues a purchase certificate. The processing may be the same processing as Act 40.

When the purchase certificate is issued, the CPU 15 ends the control processing. When the purchase certificate flag is in the reset state (i.e., set to 0), the CPU 15 determines that the result in Act 49 is No, skips Act 50, and ends the control processing.

As described above, in a case where the customer face flag is not set (i.e., set to 0), that is, in a case where the salesperson presses the first start key 11*a*, cash equal to or greater than the settlement amount is inserted, and then the CPU 15 executes the settlement processing according to the operation of the keyboard 11 by the salesperson.

On the other hand, in a case where the customer face flag is set (i.e., set to 1), that is, in a case where the salesperson presses the second start key 11*b*, cash equal to or greater than the settlement amount is inserted, and then the CPU 15 executes the settlement processing according to the operation on the sub touch panel 13 by the customer.

In this way, according to the checkout apparatus 100, the salesperson can flexibly change labor of the customer that is related to settlement. That is, for example, at busy times, when starting a procedure for settlement, the salesperson presses the second start key 11*b*, and thus the customer is allowed to perform an operation for confirmation of cash insertion completion. Thus, for example, the salesperson can concentrate on another work such as bagging of merchandise. Therefore, it is possible to shorten a time required for checkout work per customer. In this case, the labor of the customer increases, but awaiting time of the customer is shortened, and thus the customer enjoys a benefit corresponding to the labor. On the other hand, at off-peak times, when starting a procedure for settlement, the salesperson presses the first start key 11*a*, and thus the salesperson is allowed to perform an operation for confirmation of cash insertion completion. Thus, it is possible to reduce the labor of the customer. In this case, there is a possibility that the time required for checkout work per customer may increase compared to the above case. In this regard, since it is an off-peak time, the waiting time of the customer is not a big problem.

In addition, in the standby state of Act 42 to Act 44, the checkout apparatus 100 waits for only the instruction on the sub touch panel 13, and does not receive the instruction by the salesperson using the first settlement key 11*c* and the second settlement key 11*d*. Therefore, the settlement processing is not started in a situation where the customer does not complete cash insertion. In other words, for example, customers often insert extra cash above the settlement amount in order to conveniently receive change. For example, in a case where the settlement amount is 998 yen, there is a case where a customer first inserts a 1,000 yen bill and then inserts 98 yen coins. In this case, at a stage when the 1,000 yen bill is inserted, since the inserted amount is equal to or greater than the settlement amount, the settlement may be performed in the situation. At this time, if the salesperson may instruct start of the settlement processing, despite the fact that the customer is about to insert 98 yen coins, there is a concern that the settlement processing may be started before insertion of the coins. However, according to the checkout apparatus 100, it is possible to avoid such a problem.

Further, when the salesperson presses the stop key 11*e*, the checkout apparatus 100 stops the cash insertion process, discharges the inserted cash, and returns to a state of waiting for cash insertion start. Accordingly, it is possible to start again cash insertion from the beginning.

In this embodiment, the following various modifications are possible.

In any state of the standby state of Act 12, the standby state of Act 15 and Act 16, the standby state of Act 18 and Act 19, the standby state of Act 32 to Act 34, and the standby state of Act 42 to Act 44, when another operation is performed, the CPU 15 may proceed to processing according to the operation. Here, in the standby state of Act 42 and Act 43, even when the first settlement key 11*c* or the second settlement key 11*d* is pressed, the CPU 15 does not proceed to the settlement processing of Act 47. That is, in the standby state of Act 42 to Act 44, the CPU 15 disables the settlement execution instruction by the first settlement key 11*c* or the second settlement key 11*d*. Here, it is not necessarily required to disable the settlement execution instruction by the first settlement key 11*c* or the second settlement key 11*d* in this manner. An operation rule in which a salesperson does not perform the settlement execution instruction by the first settlement key 11*c* or the second settlement key 11*d* contrary to an intention of a customer, is set, and the CPU 15 may receive the settlement execution instruction by the first settlement key 11*c* or the second settlement key 11*d*.

While confirming whether or not the settlement execution instruction by the customer is performed in Act 32 to Act 34, the CPU 15 may perform, for example, an error display or the like in response to the instruction, and may not perform the settlement processing.

In addition, while confirming whether or not the settlement execution instruction by the salesperson is performed in Act 42 to Act 44, the CPU 15 may perform, for example, an error display or the like in response to the instruction, and may not perform the settlement processing.

An additional CPU different from the CPU 15 may be provided, and a part of the control processing described in the above embodiment may be executed by the additional CPU. For example, an additional CPU may be provided in the money receiving unit 20, and the additional CPU may control each unit in the money receiving unit 20 and calculate the inserted amount by adding the amount of money counted by the coin count unit 22 and the amount of money counted by the bill count unit 25.

In the checkout apparatus 100, a direction facing the salesperson side and a direction facing the customer side may intersect with each other. In this case, the rotatable angle of the money receiving unit 20 with respect to the main unit 10 may be approximately 90 degrees.

The cash insertion to the money receiving unit 20 may be performed by a customer at all times. In this case, a structure which allows the money receiving unit 20 to rotate with respect to the main unit 10, and the direction detection unit 27 may be omitted.

The checkout apparatus 100 is generally installed in a state where the control program is stored in the ROM 16. Here, the checkout apparatus 100 may be installed in a state where the control program is not stored in the ROM 16, and the control program may be installed from a removable recording medium or via a network. In this case, for example, according to an operation by the user, the control program is written into an auxiliary storage unit such as the RAM 17 or a hard disk drive (HDD) separately provided. As the removable recording medium, a magnetic disk, a magneto-optical disk, an optical disk, a semiconductor memory, or the like may be used.

All or some of functions of the control processing that are realized by the CPU 15 may be realized by hardware such as a logic circuit that executes information processing not based on a program. In addition, each of the functions may also be realized by combining software control with the hardware such as a logic circuit.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A settlement apparatus, comprising:

a first display device positioned facing an operator side of the settlement apparatus;

a first input device positioned facing the operator side, the first input device including a keyboard including at least one settlement execution key;

a second display device positioned facing a customer side of the settlement apparatus;

a second input device positioned facing the customer side;

a money receiving unit having one or more ports configured to receive and discharge money, the money receiving unit being rotatable between a first position facing the operator side and a second position facing the customer side;

and a processor configured to:

receive registration information relating to merchandise for purchase in a transaction, generate a total price of the transaction based on the registration information, display, on the first display device and the second display device, the generated total price and a current total amount of money inserted into the money receiving unit, receive an input from the first input device indicating one of the operator and the customer should confirm completion of a settlement transaction, when the received input from the first input device indicates that the customer should confirm completion of the settlement transaction, control the second display device to display at least one settlement execution button, complete the settlement transaction based on an input received in the second input device with respect to the at least one settlement execution button, and when the received input from the first input device indicates that the operator should confirm completion of the settlement transaction, the processor completes the settlement transaction based on a second input received in the first input device with respect to at least one settlement execution key.

2. The settlement apparatus according to claim 1, wherein the processor does not complete the settlement transaction based on the second input received in the first input device with respect to at least one settlement execution key, when the received input from the first input device indicates that the customer should confirm completion of the settlement transaction.

3. The settlement apparatus according to claim 1, wherein:

the at least one settlement execution button includes a first settlement execution button and a second settlement execution button, and the processor completes the settlement transaction including issuance of a purchase certificate when the input received in the second input device is with respect to the first settlement execution button.

4. The settlement apparatus according to claim 3, wherein the processor completes the settlement transaction without issuing the purchase certificate when the input received in the second input device is with respect to the second settlement execution button.

5. The settlement apparatus according to claim 1, wherein:

the processor is further configured to determine whether the current total amount of money inserted into the money receiving unit is greater than the generated total price, and the second display device is controlled to display the at least one settlement execution button when the current total amount of money inserted into the money receiving unit is determined to be greater than the generated total price.

6. The settlement apparatus according to claim 1, wherein:

the processor controls the second display device to display total price and a current total amount of money inserted into the money receiving unit without operation of the settlement execution button when the received input from the first input device indicates that the operator should confirm completion of the settlement transaction.

7. The apparatus according to claim 6, wherein:

the at least one settlement execution key includes a first settlement execution key and a second settlement execution key, and the processor completes the settlement transaction including issuance of a purchase certificate when the second input received in the first input device is with respect to the first settlement execution key.

8. The apparatus according to claim 7, wherein the processor completes the settlement transaction without issuing the purchase certificate when the second input received in the first input device is with respect to the second settlement execution key.

* * * * *